US008677694B2

(12) United States Patent
Ash et al.

(10) Patent No.: US 8,677,694 B2
(45) Date of Patent: Mar. 25, 2014

(54) ROOF DEFLECTOR SYSTEM

(76) Inventors: Stephen R. Ash, Lafayette, IN (US); Marianne Y. Ash, Lafayette, IN (US)

( * ) Notice: Subject to any disclaimer, the term of this patent is extended or adjusted under 35 U.S.C. 154(b) by 0 days.

(21) Appl. No.: 13/509,896

(22) PCT Filed: Dec. 10, 2010

(86) PCT No.: PCT/US2010/059793

§ 371 (c)(1),
(2), (4) Date: May 15, 2012

(87) PCT Pub. No.: WO2011/072185

PCT Pub. Date: Jun. 16, 2011

(65) Prior Publication Data

US 2012/0233931 A1 Sep. 20, 2012

Related U.S. Application Data

(60) Provisional application No. 61/283,903, filed on Dec. 10, 2009.

(51) Int. Cl.
*E04D 13/00* (2006.01)

(52) U.S. Cl.
USPC ..... 52/12; 210/154; 210/162

(58) Field of Classification Search
USPC ..... 52/11, 12; 210/154
See application file for complete search history.

(56) References Cited

U.S. PATENT DOCUMENTS

| | | | | |
|---|---|---|---|---|
| 1,101,047 | A * | 6/1914 | Yates | 52/12 |
| 2,469,841 | A | 5/1949 | Ours | |
| 2,734,467 | A | 2/1956 | Steele | |
| 2,805,632 | A * | 9/1957 | Couture | 52/12 |
| 2,841,100 | A | 7/1958 | Moller | |
| 3,121,684 | A | 2/1964 | Bugbird | |
| 3,601,835 | A | 8/1971 | Morgan | |
| 3,630,383 | A | 12/1971 | Reeves | |
| 3,834,091 | A | 9/1974 | Dugan | |
| 3,864,267 | A * | 2/1975 | Nelems | 210/474 |
| 4,573,290 | A * | 3/1986 | Fleming | 52/12 |
| 4,644,704 | A * | 2/1987 | Pedgonay | 52/12 |
| 4,765,101 | A * | 8/1988 | Wolf | 52/12 |

(Continued)

FOREIGN PATENT DOCUMENTS

| | | | | |
|---|---|---|---|---|
| DE | 3325086 A1 * | 2/1985 | | E04D 13/06 |
| DE | 4439958 A1 * | 5/1996 | | E04D 13/076 |

OTHER PUBLICATIONS

International Preliminary Report on Patentability, dated Jun. 21, 2012 in PCT/US2010/059793.

(Continued)

*Primary Examiner* — Robert Canfield
*Assistant Examiner* — Brent W Herring
(74) *Attorney, Agent, or Firm* — Barnes & Thornburg LLP

(57) ABSTRACT

A system for separating water from debris. A gutter cover is secured to a gutter and extends to engage the top of the roof adjacent the gutter along a contact line. The gutter cover may have a perforate surface comprising closely spaced and normally water impervious holes through the gutter cover such that water does not flow through the holes unless the water is forced through the holes or attracted through the holes. The line of contact forms an imperfect junction between the edge of the gutter cover and the roof so that water flows through the contact line and beneath the gutter cover.

8 Claims, 2 Drawing Sheets

(56) References Cited

U.S. PATENT DOCUMENTS

| | | | | |
|---|---|---|---|---|
| 4,841,686 | A * | 6/1989 | Rees | 52/12 |
| 5,056,276 | A | 10/1991 | Nielsen | |
| 5,092,086 | A | 3/1992 | Rognsvoog | |
| 5,406,754 | A | 4/1995 | Cosby | |
| 5,586,837 | A * | 12/1996 | Udelle | 52/12 |
| 5,875,590 | A | 3/1999 | Udelle | |
| 6,080,307 | A | 6/2000 | Morris | |
| 6,161,338 | A * | 12/2000 | Kuhns | 52/12 |
| 6,209,937 | B1 | 4/2001 | Keiter | |
| 6,701,674 | B1 * | 3/2004 | Albracht | 52/12 |
| 6,925,676 | B2 | 8/2005 | Heavner | |
| 7,191,564 | B2 * | 3/2007 | Higginbotham | 52/12 |
| 7,198,714 | B2 * | 4/2007 | Swistun | 210/162 |
| 7,765,742 | B2 * | 8/2010 | Ealer, Sr. | 52/12 |
| 7,793,465 | B2 * | 9/2010 | McCann | 52/12 |
| 8,341,891 | B1 * | 1/2013 | Pavlansky et al. | 52/12 |
| 8,397,436 | B2 * | 3/2013 | Higginbotham | 52/12 |
| 2005/0257432 | A1 * | 11/2005 | Higginbotham | 52/12 |
| 2008/0098661 | A1 * | 5/2008 | McCann | 52/12 |
| 2014/0000179 | A1 * | 1/2014 | Ealer, Sr. | 52/12 |

OTHER PUBLICATIONS

Response to Written Opinion, dated Apr. 18, 2011 in PCT/US2010/059793.

* cited by examiner

ROOF DEFLECTOR SYSTEM

RELATED APPLICATION

This application is the non-provisional filing of U.S. provisional application No. 61/283,903, filed Dec. 10, 2009, the disclosure of which is incorporated herein by reference.

BACKGROUND OF THE INVENTION

This invention relates to separation of water from debris and in particular to a roof deflector system where debris passes over a gutter cover and water passes under the gutter cover but not through the gutter cover except, if at all, proximate a contact line where the gutter cover engages the roof.

The history of housing has been marked by continuous improvement in the quality and durability of roofing materials. Roofing materials can easily last more than twenty years, repelling rain, leaves and dirt.

A persistent problem has been how to accommodate leaves, other debris and rain falling on the roof Gutters and similar devices have been devised to collect rain water and debris and convey the collected material by gravity for release in a desired location out of contact with individuals entering or leaving the structure over which the roof is formed.

While gutters perform well their intended tasks, unfortunately they typically require frequent cleaning because the flow of water and size of the gutter and down spouts are not sufficient to remove leaves and other debris from the gutter. Thus, open gutters have typically required periodic cleaning, which can be a tedious and dangerous task.

Many types of systems have been devised to prevent leaves and debris from entering the gutter, while still allowing water to enter. One approach has been to place some type of screen over or on top of the gutter, but under adjacent shingles or roof material, so that debris collects on the screen and, theoretically, is washed or blown therefrom. However, small debris particles can pass through the screen or collect thereon, and those passing through the screen still collect in the gutter over time. Furthermore, leaves tend to stick in the mesh of the screens, creating water blockage and a poor appearance. Intermittently, leaves must be removed from the screens, and the screens must be opened or otherwise removed so that debris can be removed from the gutter.

Another general approach to gutter protection is by means of extending a solid cover over the gutter, and allowing water to enter through a much-reduced opening area. This type of cover allows water to pass over the cover and then enter the gutter from a curved front end of the cover, taking advantage of surface tension of water on the cover. Leaves and other debris fall from the cover, missing the gutter entirely. These covers have an upper edge that is placed under a shingle or the edge of the roof to assure that all the water reaching the cover goes over its surface. These covers have some water spillover problems and are prone to develop icicles in cold weather. They are also expensive to install, fragile and cannot be opened.

SUMMARY OF THE INVENTION

The invention is directed to a deflector system for separating water from debris. The entire system involves a roof having a gutter extending along at least a portion of peripheral edges of the roof. A gutter cover is secured to the gutter and extends to engage the roof along a contact line. In one form, the gutter cover has a perforate surface, with the perforate surface comprising closely spaced and normally water impervious holes through the cover such that water does not flow through the holes unless the water is forced through the holes or attracted through the holes.

In a preferred form of the invention, the gutter cover is hingedly secured to the gutter. The holes are generally circular with a diameter of about one-eighth inch maximum. In one form of the cover, the perforate surface extends across the gutter cover. In another form of the invention, the perforate surface is only proximate the contact line. In yet another form, there is no perforation at all.

The contact line forms an imperfect junction between an edge of the gutter cover and the roof, such that water flowing along the roof at the contact line flows through the contact line and beneath the gutter cover. In one form of the invention, the imperfect junction comprises a substantially smooth roof surface and a perforate portion of the edge of the gutter cover. In another form of the invention, the imperfect junction comprises a rough roof surface and a smooth edge of the gutter cover. In yet another form of the invention, the imperfect junction comprises a combination of a rough roof surface and a perforate portion of the edge of the gutter.

BRIEF DESCRIPTION OF THE DRAWINGS

The invention is described in greater detail in the following description of examples embodying the best mode of the invention, taken in conjunction with the drawing figures, in which.

DESCRIPTION OF EXAMPLES EMBODYING THE BEST MODE OF THE INVENTION

The invention is radically different from any known prior art screen or solid cover approach. The invention consists of a deflector comprising a plate or gutter cover that is attached to the outer edge of a gutter, with the inner edge of the deflector resting on top of the roof, forming a slope downwardly from the contact line to the outer edge of the gutter. The downward slope is on the order of 30 degrees, although it can be somewhat more or substantially less. When water runs down the roof, water meets the edge of the gutter cover but passes under or through the peripheral edge of the gutter cover and remains generally on the roof surface until it falls into the gutter. Leaves and other debris cannot pass through the contact line or the small perforations in the gutter cover, and therefore pass onto the surface of the gutter cover, typically passing over the outer edge of the gutter when blown by wind.

Water passing down the roof and under the gutter cover is counter-intuitive. It occurs because surface tension of water to the roof is stronger, due to the irregular roof surface, than the surface tension of water to the smooth gutter cover, and because the contact line between the gutter cover and the roof does not form a perfect seal. In normal use, the gutter cover, when it is a perforated plate, actually repels water, since water normally cannot pass through the holes in the gutter cover because they are too small. This is because surface tension limits formation of drops on the underside of the small holes in the gutter cover, normally preventing water flow through the gutter cover. However, water can be forced through the holes by increased pressure or by attraction proximate the contact line, where water beneath the gutter cover contacts the water in the holes proximate the contact line and draws water through the holes. This flow is also advantageous since it helps move leaves and debris from the contact line, and after rain has ceased, the perforations in the gutter cover allow air passage to promote drying of the gutter. During dry periods, leaves and other debris on the roof that have reached the gutter cover pass over the gutter cover and fall away.

Figure 1:
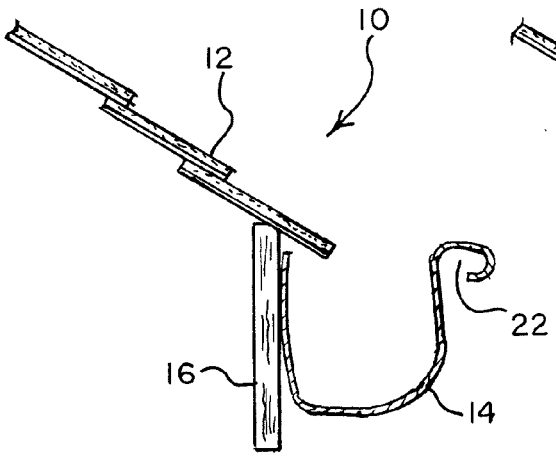
FIG. 1 is a side elevational illustration of a typical pitched roof having an eave gutter into which water flowing from the roof passes.

FIG. 1 illustrates a typical roof and gutter system 10. The roof, whose structure is not shown in detail, is capped by shingles or any other kind of roof surface 12, with the roof being pitched as illustrated. Water falling on the surface 12 passes downwardly by gravity into a gutter 14 with the gutter 14 being secured to the building facia 16 or otherwise held in place.

Figure 2:
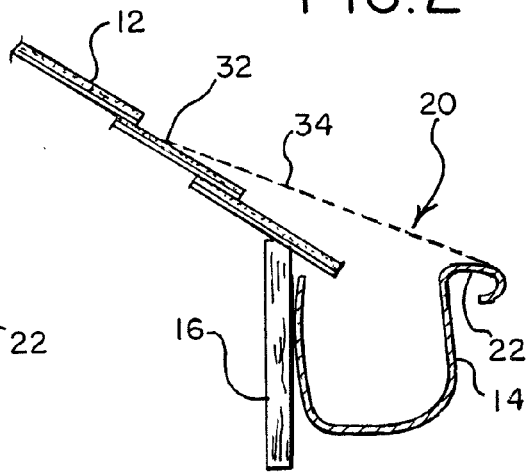
FIG. 2 is an elevational illustrational, similar to FIG. 1, but employing a gutter cover according to the invention.

In FIG. 2, the same roof and gutter system 10 of FIG. 1 is illustrated, with a gutter cover 20 according to the invention. The gutter cover 20 is appropriately affixed to an outer lip 22 of the gutter 14, as explained below, and rests on the roof, on top of the surface 12.

Figure 3:
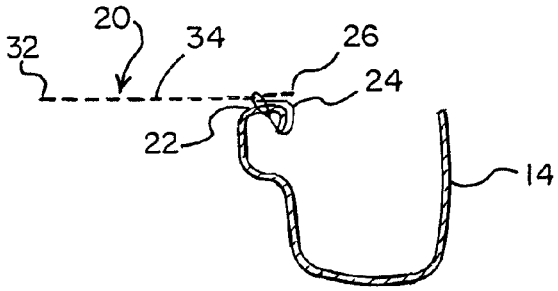
FIG. 3 is a slightly enlarged view of a gutter having the gutter cover according to the invention, when the gutter cover has been rotated along its hinged edge to allow access into the gutter.

Preferably, the gutter cover 20 is hingedly secured to the outer lip 22. That can be by many means. The gutter cover 20 can be secured by periodic tethers 24 at an outer edge 26 of the gutter cover 20, with the tethers 24 comprising wires, plastic lines such as fish line, rope, fasteners, or other similar attachment means. The tethers 24 pass through appropriate holes (not illustrated) in the outer lip 22 and are secured to one another or to the outer lip 22, as appropriate. Because the tethers 24 are at the outer edge 26 and are flexible, the gutter cover 20 may thus be hingedly opened as shown in FIG. 3.

Figure 9:
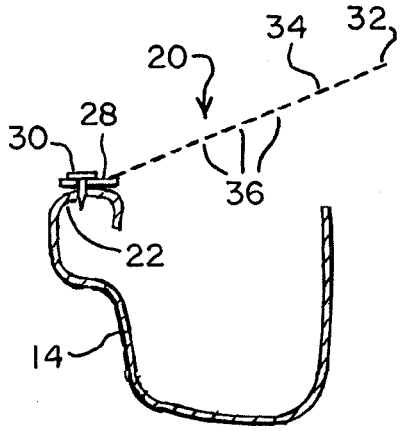
FIG. 9 is a view similar to FIG. 8, with the roof and water flow omitted, and showing a different means of attachment of the gutter cover to a gutter.

Another means of affixing is with an actual hinge 28, shown schematically in FIG. 9. The hinge can be secured to the outer lip 22 by fasteners 30 or any other means, allowing rotational movement of the gutter cover 20. Other means of hinged connection will be evident to those skilled in the art.

The gutter cover 20 has an inner edge 32 that rests on the roof surface 12. The nature of the inner edge 32 and its interaction with the roof surface 12 is described in further detail.

Figure 4:
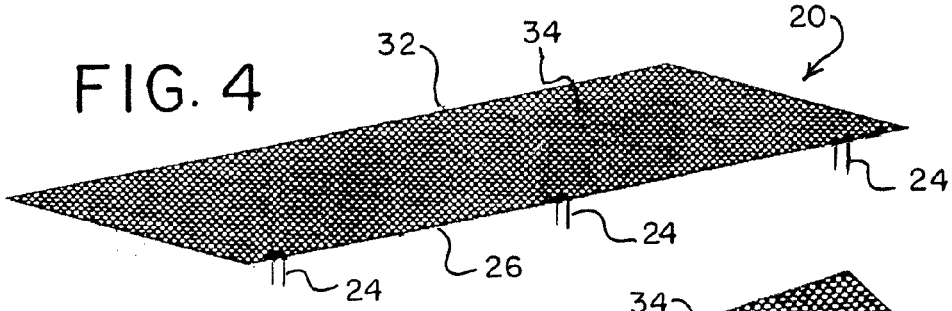
FIG. 4 is an isometric view of one of one form of gutter cover according to the invention.
Figure 5:
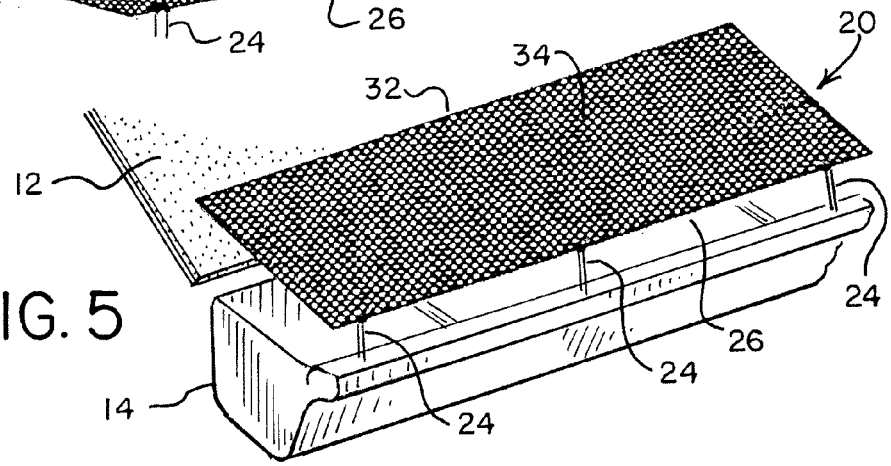
FIG. 5 is a view of the gutter cover of FIG. 4, when being installed on an eave gutter.

As best shown in FIGS. 4 and 5, in one form, the gutter cover 20 includes a perforate surface 34. As illustrated in the drawings, the perforate surface 34 may cover the entire gutter cover 20, or may be just proximate the inner edge 32. In all instances, the perforate surface 34 comprises a series of closely spaced and normally water impervious holes 36, which are greatly exaggerated in FIGS. 2, 3 and 7 through 9 for illustrative purposes. The holes are sufficiently small so that water normally flows on top of the gutter cover 20 and not through the holes 36 unless water is forced through the holes 36 or attracted through the holes 36, typically by contact with water thereunder. It has been found that circular holes with a diameter of about one eighth inch maximum, or smaller, serve this purpose.

The term "perforate surface" as used herein means a surface that is otherwise generally smooth, but includes the holes 36 therethrough. Also, while the holes 36 are preferably circular in cross section, other shapes may be used so long as they function as explained herein.

Figure 6:
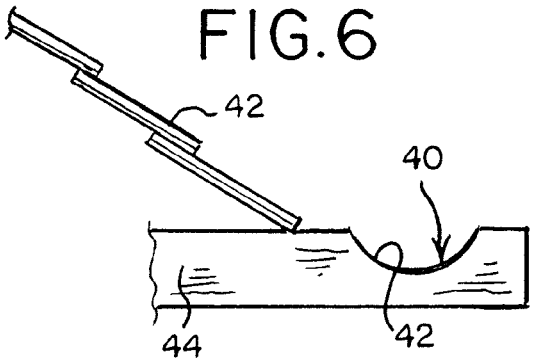
FIG. 6 is an elevational illustration of a swale type of gutter at the edge of a pitched roof.
Figure 7:
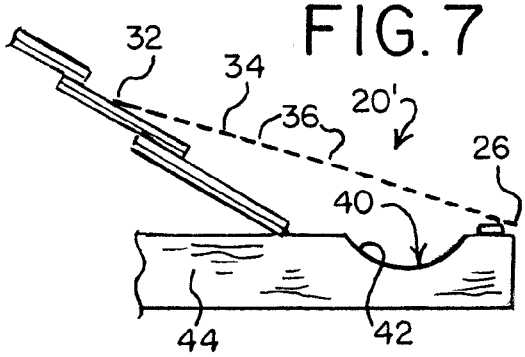
FIG. 7 is a view similar to FIG. 6, but employing the gutter cover according to the invention.

FIGS. 6 and 7 illustrate the invention when employed in connection with a swale gutter 40. Swale gutters 40 are made by cutting notches 42 in extending ceiling joists 44, and the roof includes typical shingles or another appropriate roof surface 42. The extended joists 44 are covered with thin wood and metal, usually copper, to make a gutter of a width of a foot or more. In this form of the invention, the gutter cover 20' is identical to that of the first form of the invention, except wider. Thus, reference numerals for the elements of the gutter cover 20' are identical to those of the first form of the invention.

The inner edge 32 engages the roof along a contact line co-terminal with the inner edge 32 when on the roof. As explained above, the contact line is not a perfect seal, but just the opposite. It is sized to allow water to flow under the gutter cover 20, while leaves and other debris pass over the gutter cover 20. The contact line is therefore an imperfect junction between the inner edge 32 of the gutter cover 20 and the roof.

The imperfect junction can be formed in many fashions. If the roof surface is generally smooth, the imperfect junction can comprise a perforate portion of the edge 32, that perforate portion being formed in many different ways. One way is to simply cut the gutter cover 20 along a line of the holes 36. How ever that perforate portion of the edge 32 is formed, however, it is sized on the order of the holes 36.

Another way of forming the imperfect junction is to employ a rough roof surface and a smooth edge 32 of the gutter cover 20. For example, typical shingled roofs have a granular surface. That granular surface is sufficiently rough so that a smooth edge 32 of the gutter cover 20 resting on the roof forms an adequate imperfect junction.

Another means of forming the imperfect junction is a combination of both a rough roof surface and a perforate portion of the edge 32. The edge 32 can be formed as described immediately above and impinge on a granular surface of a shingled roof, or other such imperfect surface.

Another means of forming an imperfect junction between a smooth roof and smooth gutter cover is to purposely create a gap of less that ⅛" at the line of contact between the roof surface and gutter cover by creating various projections or shapes in the gutter cover.

Figure 8:
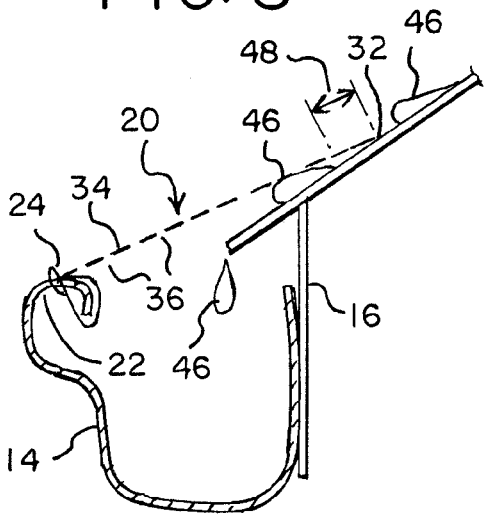
FIG. 8 is a schematic elevational illustration showing the gutter cover according to the invention and depicting water flow.
Figure 10:
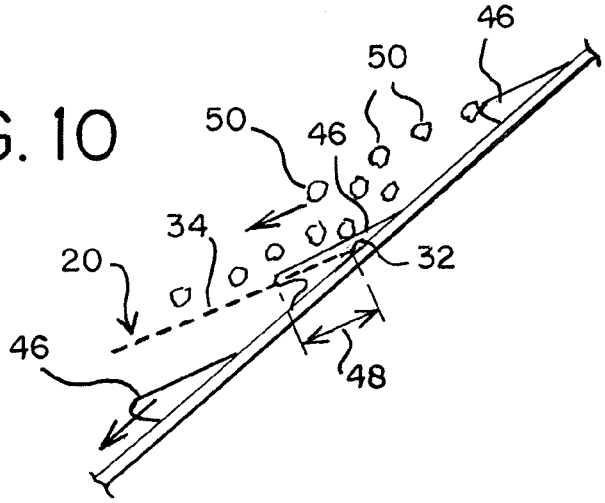
FIG. 10 is an enlarged view similar to FIG. 8, with the gutter omitted, depicting water flow beneath and through the gutter cover with debris passing over the gutter cover.

FIGS. 8 and 10 illustrate the characteristics of the invention. Water 46 flows down the roof, encountering the inner edge 32, which is also the contact line at the roof. Most of the water 46 flows under the inner edge 32, continuing down the roof and into the gutter 14. However, depending on the nature of the imperfect surface along the contact line, as well as the amount of water flowing on the roof, some water may flow past the inner edge 32 onto the top of the gutter cover 20. That water, while normally not able to flow through the holes 36, is attracted to water beneath the gutter cover 20, however, and is drawn through the perforate surface 34 proximate the inner edge 32. The area 48 is defined as that portion of the gutter cover 20 where water flowing under the gutter cover 20 attracts water on the top of the gutter cover 20 by means of contact and surface tension. Any debris 50 that is traveling with the water, however, is far too large to enter the holes 36, and therefore, as illustrated in FIG. 10, continues along the upper surface of the gutter cover 20.

Water enters through the perforate surface 34 of the gutter cover 20 in one other fashion, and that is by force. As explained above, normally water does not pass through the gutter cover 20 unless attracted. However, rain drops falling on to the upper surface of the gutter cover 20 have sufficient momentum to be forced substantially through the holes 36. Wind pressure on top of the gutter cover 20 may also be sufficient to force water through the holes 36. While a small amount of rain may spill over the outer lip 22, that is advantageous in that it also helps carry debris thereover. Any leaves or debris remaining on the gutter cover 20 after rain has ceased will dry and then be removed by wind.

Various changes can be made to the invention without departing from the spirit thereof or scope of the following claims.

What is claimed:

1. A roof deflector system for separating water from debris, a. a roof having a gutter extending along at least a portion of peripheral edges of the roof, b. a gutter cover secured to the gutter and extending to engage the roof along a contact line, said gutter cover including a perforate surface, said perforate surface comprising closely spaced and normally water impervious holes through the gutter cover such that water does not flow through said holes unless the water is forced through said holes or attracted through said holes, and c. the contact line forming an imperfect junction between an edge of said gutter cover and the roof, such that water flowing along the roof at said contact line flows through said contact line and beneath said gutter cover.

2. The roof deflector system according to claim 1, in which said holes are generally circular with a diameter of about ⅛ inch maximum.

3. The roof deflector system according to claim 1, in which said perforate surface extends across said gutter cover.

4. The roof deflector system according to claim 1, in which said perforate surface is proximate said contact line.

5. The roof deflector system according to claim 1, in which said gutter cover is hingedly secured to said gutter.

6. The roof deflector system according to claim , in which said imperfect junction comprises a substantially smooth roof surface and a perforate portion of said edge of said gutter cover.

7. The roof deflector system according to claim 1, in which said imperfect injunction comprises a rough roof surface and a smooth edge of said gutter cover.

8. The roof deflector system according to claim 1, in which said imperfect junction comprises a rough roof surface and a perforate portion of said edge of said gutter cover.

* * * * *